US006520162B1

(12) United States Patent
Schueler

(10) Patent No.: US 6,520,162 B1
(45) Date of Patent: Feb. 18, 2003

(54) FUEL INJECTION SYSTEM

(75) Inventor: Peter Schueler, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/458,948

(22) Filed: Dec. 1, 1999

(30) Foreign Application Priority Data

Dec. 11, 1998 (DE) ..... 198 57 249

(51) Int. Cl.[7] ..... F02M 37/04
(52) U.S. Cl. ..... 123/510; 123/198 D; 210/90
(58) Field of Search ..... 123/514, 510, 123/456, 446, 506, 198 D; 210/416.4, 130, 90

(56) References Cited

U.S. PATENT DOCUMENTS 3,591,003 A * 7/1971 Cooper ..... 210/90
3,618,777 A * 11/1971 Meyer ..... 210/130
3,970,104 A * 7/1976 Decker et al. ..... 210/90
4,423,751 A * 1/1984 Roettgen ..... 137/557
5,078,167 A * 1/1992 Brandt et al. ..... 137/549
5,195,494 A * 3/1993 Tuckey ..... 123/514
5,636,616 A * 6/1997 Okane et al. ..... 123/514
5,649,561 A * 7/1997 Brandt ..... 137/115.13
5,797,374 A * 8/1998 Minagawa et al. ..... 123/497
5,873,349 A * 2/1999 Tuckey et al. ..... 123/514
5,887,572 A * 3/1999 Channing ..... 123/514
5,896,846 A * 4/1999 Bauer et al. ..... 123/510
6,007,711 A * 12/1999 Atwood ..... 210/136
6,021,759 A * 2/2000 Okajima et al. ..... 123/467
6,021,761 A * 2/2000 Kellner et al. ..... 123/495
6,125,826 A * 10/2000 Brocard et al. ..... 123/510
6,159,383 A * 12/2000 Gullett et al. ..... 210/741

* cited by examiner

*Primary Examiner*—Carl S. Miller
(74) *Attorney, Agent, or Firm*—Ronald E. Greigg

(57) ABSTRACT

The invention relates to a fuel injection system, in particular a common rail system, with a pre-feed pump, which delivers a fuel flow from a fuel tank to a high-pressure pump. A fuel filter is disposed downstream or upstream of the pre-feed pump in terms of the feed direction. A safety switch which is dependent upon the fuel filter pressure difference, is provided in order to protect the pre-feed pump and the high-pressure pump by diverting overly pressurized flow back to the fuel.

24 Claims, 1 Drawing Sheet

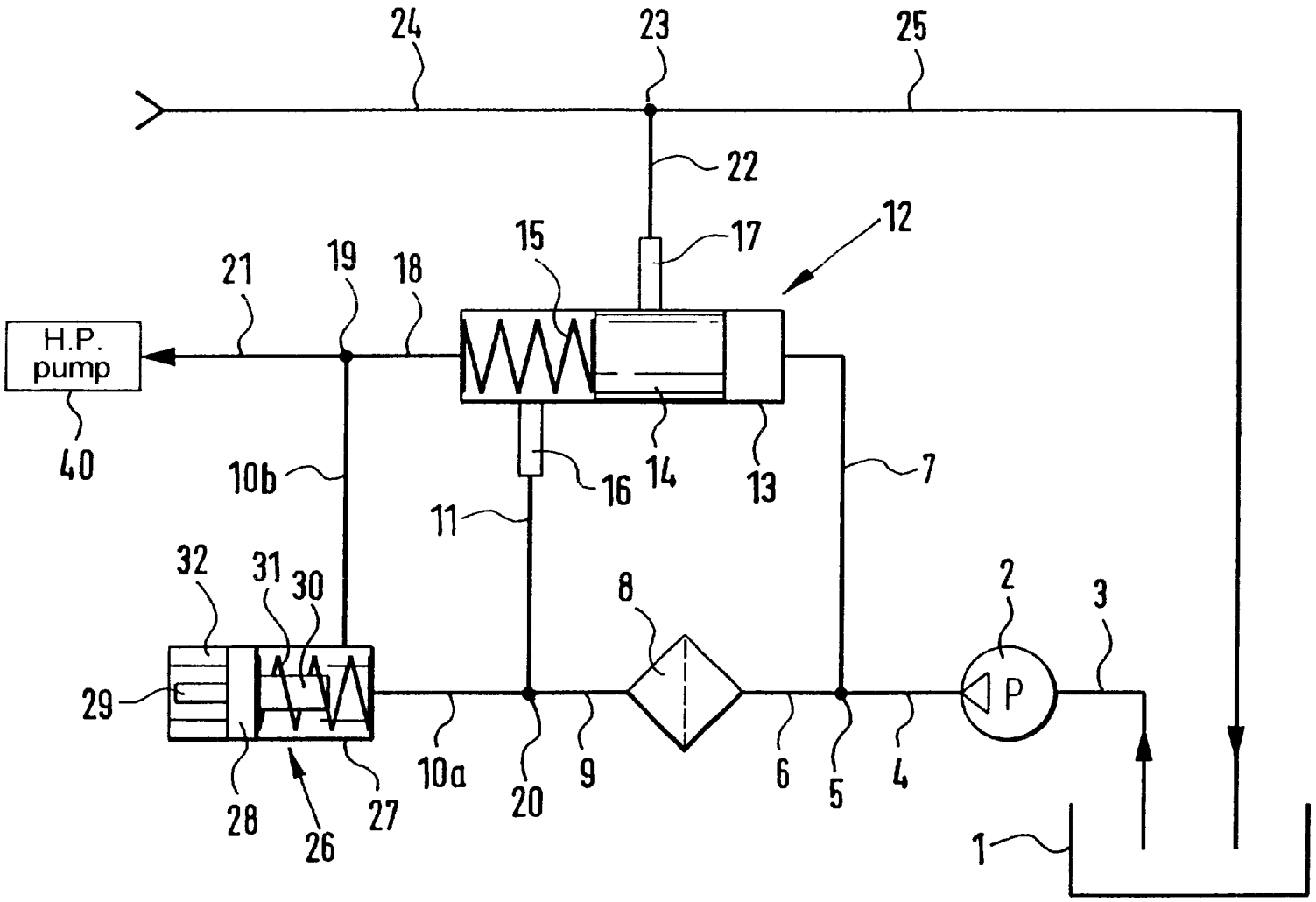
H.P.
pump
1
2
3
4
5
6
7
8
9
10a
10b
11
12
13
14
15
16
17
18
19
20
21
22
23
24
25
26
27
28
29
30
31
32
40

FUEL INJECTION SYSTEM

BACKGROUND OF THE INVENTION

The invention relates to a fuel injection system, in particular a common rail system, with a pre-feed pump that delivers a fuel flow from a fuel tank to a high-pressure pump, wherein a fuel filter is disposed downstream or upstream of the pre-feed pump in terms of the feed direction.

Failures of the pre-feed pump and the high-pressure pump have occurred in the operation of fuel injection systems of this type. In tests carried out within the scope of the current invention, it has turned out that the failures of the high-pressure pump are due to an insufficient supply of fuel.

OBJECTS OF THE INVENTION

The principal object of the current invention is to produce a fuel injection system in which the service life of the pre-feed pump and the high-pressure pump is increased.

A further object of the invention is that damage to the drive mechanism of the high-pressure pump should be prevented in the event of an insufficient supply quantity.

SUMMARY OF THE INVENTION

In a fuel injection system, in particular a common rail system, with a pre-feed pump that delivers a fuel flow from a fuel tank to a high-pressure pump, in which a fuel filter is disposed downstream or upstream of the pre-feed pump in relation to the feed direction, the inventive object is attained by means of a safety switch that is dependent on the fuel filter pressure difference. The supply quantity of the high-pressure pump is essentially dependent on the delivery pressure to be produced by the pre-feed pump. As the fuel filter becomes contaminated, the delivery pressure increases as a result of the rising through flow resistance. The delivery quantity decreases based on the pre-feed pump characteristic curve. In the known common rail systems, a clogging of the fuel filter is not detected promptly enough so that the above-mentioned failures can occur. The safety switch according to the invention prevents an impermissible increase in the delivery pressure. As a result, both the pre-feed pump and the high-pressure pump are protected. It is also conceivable to provide pressure sensors before and after the fuel filter with which the pressure differential can be detected.

A particular embodiment of the invention is characterized in that a valve device is provided which supplies the fuel flow delivered by the pre-feed pump either back into the fuel tank or to the high-pressure pump depending on the fuel filter pressure difference. Viewed in terms of the flow direction, if the pressure upstream of the fuel filter increases too intensely as a result of contamination, the fuel flow from the pre-feed pump is no longer supplied to the high-pressure pump, but back into the fuel tank. As a result, the motor is switched off and the high-pressure pump is protected.

Another particular embodiment of the invention is characterized in that the valve device has a valve housing in which a spring-preloaded control piston can move back and forth, and depending on the fuel filter pressure difference, this control piston unblocks a shutoff bore in the valve housing, through which the fuel flow delivered by the pre-feed pump travels to the high-pressure pump, or unblocks a diversion bore in the valve housing, through which the fuel flow delivered by the pre-feed pump travels back into the fuel tank. The shutoff bore to the high-pressure pump is already closed to a large extent before the diversion bore to the fuel tank is opened in order to produce a rapid shutoff when the critical fuel filter pressure differential is reached. A critical pressure differential value can be predetermined by means of the initial stress of the spring. As soon as this critical pressure differential value is reached, the diversion bore in the valve housing is unblocked. When there is a lower pressure difference, the injection system functions normally.

Another particular embodiment of the invention is characterized in that an expansion material element is disposed in a bypass that circumvents the valve device. The safety switch according to the invention would also be triggered by means of gelled fuel at low temperatures. In order to prevent this, the expansion material element is disposed parallel to the valve device. At low temperatures, the expansion material element opens the bypass and assures that the fuel flow delivered by the pre-feed pump reaches the high-pressure pump.

Another particular embodiment of the invention is characterized in that the valve device and/or the expansion material element are integrated into a cover of the fuel filter. This produces a particularly compact embodiment which is suitable for a modular construction.

The invention will be better understood and further objects and advantages thereof will become more apparent from the ensuing detailed description of a preferred embodiment taken in conjunction with the drawing. The features mentioned in the claims and in the description can be essential to the invention each individually or in arbitrary combinations.

BRIEF DESCRIPTION OF THE DRAWING

In the accompanying FIGURE of drawings, the fuel injection system according to the invention is depicted by means of a hydraulic circuit diagram.

DESCRIPTION OF THE PREFERRED EMBODIMENT

A pre-feed pump 2 aspirates fuel from a fuel tank 1 by way of a line 3. The fuel is used for the fuel supply of a diesel engine. The safety switch according to the invention constitutes the part of the low-pressure circuit of a common rail injection system. However, this safety switch can in principle also be used in other injection systems in which operation with overly contaminated fuel filters should be avoided. Since the fuel filter pressure differential depends on the through flow quantity and as a rule, this in turn depends on the engine speed, at first, the function of the safety switch only engages at a high engine speed so that a limited operation of the engine at a reduced speed and also with a permissible pressure drop at the fuel filter remains possible.

Tests have been carried out within the scope of the current invention in which it has turned out that damage to the pre-feed pump can occur due to filter clogging. It is possible for the delivery pressure to rise so high that a pressure limitation valve integrated into the pre-feed pump reacts. Then dirt particles that have passed through the pre-filter become lodged in the sealing seat of the pressure limitation valve which results in a constant leak and the delivery capacity of the pre-feed pump is correspondingly impaired.

The delivered fuel flow travels from the pre-feed pump 2 by way of a line 4 to a branching point 5. The branching point 5 connects the line 4 to two lines 6 and 7. The line 6 leads to a fuel filter 8. The fuel flow supplied by the pre-feed pump 2 is cleaned in the fuel filter 8. The delivered fuel flow travels from the fuel filter 8 by way of a line 9 to another branching point 20.

The branching point 20 connects the line 9 to two other lines 10*a* and 11. The delivered fuel flow travels by way of the line 11 to a valve device 12. The valve device 12 has a valve housing 13 in which a control piston 14 is contained so that it can move back and forth. The valve housing 13 is connected by way of the lines 7 and 11 with both the inlet side and the outlet side of the fuel filter 8. The control piston 14 is prestressed by means of a spring 15 in the valve housing 13.

The position of the control piston 14 in the valve housing 13 changes depending upon the fuel filter pressure difference. In the position of the control piston 14 shown in the drawing, a shutoff bore 16 is opened. By means of the shutoff bore 16, fuel can travel from the outlet side of the fuel filter 8 by way of the lines 9 and 11 into a line 18. The line 18 ends in another branch point 19 from which a line 21 leads to a high-pressure pump 40, shown in box form in the drawing.

If the pressure on the inlet side of the fuel filter 8 increases, this leads to the fact that the control piston 14 is moved toward the left counter to the initial stress of the spring 15 in the valve housing 13. This results in the fact that the control piston 14 closes the shutoff bore 16. If the shutoff bore 16 is closed, no more fuel can travel by way of the line 11 to the high-pressure pump. The sliding of the control piston 14 toward the left also leads to the fact that a diversion bore 17 in the valve housing 13 is unblocked. This in turn results in the fact that the fuel flow delivered by the pre-feed pump 2 travels by way of the line 7 into a line 22. The line 22 leads to another branch point 23. The branch point 23 is also fed by a line 24 that comes from the motor. The fuel from the lines 22 and 24 is conveyed back into the fuel tank by way of the branch point 23 and a line 25.

By means of the switch according to the invention, the through flow through the fuel filter 8 is shut off when a pressure differential value is reached that can be predetermined by means of the initial stress of the spring 15. In addition, the fuel flow delivered by the pre-feed pump 2 is conveyed back to the fuel tank 1. As a result, the motor is switched off and the high-pressure pump is protected.

In order to prevent a shutoff due to gelled fuel at low temperatures, a valve 26 which switches in a temperature-dependent manner is disposed parallel to the shutoff bore 16 between the lines 10*a* and 10*b*. The valve 26 contains an expansion material element 28 which is contained so that it can move back and forth in a valve housing 27. A pin 29 protrudes from the wax-filled expansion material element 28 and the end of the pin is supported against the valve housing 27. On the end opposite from the pin 29, the expansion material element 28 is embodied as piston-shaped, by means of which the communication between the lines 10*a* and 10*b* is interrupted at temperatures above the gelling point of the diesel fuel. At lower temperatures, the initial stress of the compression spring 31, which is disposed in the valve housing 27, assures that the expansion material element 28 is slid toward the left against the pin 29 until it reaches the stop element 32 and as a result, the communication between the lines 10*a* and 10*b* is produced.

In the state of the switching valve 26 shown in the drawing, gelled fuel can travel to the high-pressure pump by means of the lines 10*a* and 10*b*. If the pin 29 is pressed out from the expansion material element 28 due to heating, the pin is supported against the valve housing 27. A further expansion of the wax filling of the expansion material element 28 then results in the fact that the expansion material element 28 is slid toward the right and the line 10*a* is closed. Only when gelled fuel at low fuel temperatures must be reckoned with does the switching valve 26 assure that the motor can be operated further.

The principal schematically depicted in the drawing naturally also functions when the pre-feed pump 2 is disposed after the fuel filter 8. The fuel injection system shown, in particular its high-pressure pump, is automatically protected against contaminated fuel filters even when a filter change is not carried out. The fuel filter 8 is a so-called main fuel filter. As a rule, a coarse-meshed pre-filter is also used in addition to this main fuel filter.

The switch according to the invention does not limit the operation of the motor with gelled fuel. The switch is fundamentally reversible and, with a corresponding software strategy, permits a limited driving operation at a low engine speed.

The foregoing relates to a preferred exemplary embodiment of the invention, it being understood that other variants and embodiments thereof are possible within the spirit and scope of the invention, the latter being defined by the appended claims.

I claim:

1. A fuel injection system comprising a common rail system provided with a pre-feed pump (2) for delivering a fuel flow from a fuel tank to a high-pressure pump (40), a fuel filter (8) in the system between the fuel tank and the high pressure pump, pressure differential sensing means connected in the system for sensing a pressure differential across the filter (8) and, a safety valve device (12) that is dependent upon a fuel filter pressure difference for shutting off fuel flow through the filter, wherein said safety valve device (12) is provided which is operative between two positions to supply fuel flow delivered by the pre-feed pump (2) depending upon a fuel filter pressure difference, said first position being a flow back into the fuel tank and said second position being a flow to the high-pressure pump.

2. The fuel injection system according to claim 1, wherein said safety valve device (12) is operable to return fuel from said pre-feed pump to the fuel tank to thereby shut down the system and protect the high-pressure pump (40).

3. A fuel injection system, comprising a common rail system provided with a pre-feed pump (2), for delivering a fuel flow from a fuel tank (1) to a high-pressure pump, a fuel filter (8) disposed downstream of the pre-feed pump (2) in terms of the feed direction, pressure differential sensing means connected in the system for sensing a pressure differential across the filter, a safety valve device (12) that is dependent on a fuel filter pressure difference for shutting off flow through the filter, and a bypass (10) to circumvent the safety valve device (12).

4. A fuel injection system, comprising a common rail system provided with a pre-feed pump (2), for delivering a fuel flow from a fuel tank (1) to a high-pressure pump, pressure differential sensing means connected in the system for sensing a pressure differential across the filter, and a fuel filter (8) disposed upstream of the pre-feed pump (2) in terms of the feed direction, a safety valve device (12) that is dependent on a fuel filter pressure difference for shutting off flow through the filter, and a bypass (10) to circumvent the safety valve device (12).

5. A fuel injection system, comprising a common rail system provided with a pre-feed pump (2), for delivering a fuel flow from a fuel tank (1) to a high-pressure pump, a fuel filter (8) disposed downstream of the pre-feed pump (2) in terms of the feed direction, pressure differential sensing means connected in the system for sensing a pressure differential across the filter, and a safety valve device (12) that is dependent on a fuel filter pressure difference for shutting off flow through the filter, wherein said safety valve device (12) is provided which is operative between two positions to supply fuel flow delivered by the pre-feed pump (2) depending upon a fuel filter pressure difference, said first position being a flow back into the fuel tank and said second position being a flow to the high-pressure pump.

6. A fuel injection system, comprising a common rail system provided with a pre-feed pump (2), for delivering a fuel flow from a fuel tank (1) to a high-pressure pump, pressure differential sensing means connected in the system for sensing a pressure differential across the filter, and a fuel filter (8) disposed upstream of the pre-feed pump (2) in terms of the feed direction, and a safety valve device (12) that is dependent on a fuel filter pressure difference, for shutting off flow through the filter, wherein said safety valve device (12) is provided which is operative between two positions to supply fuel flow delivered by the pre-feed pump (2) depending upon a fuel filter pressure difference, said first position being a flow back into the fuel tank and said second position being a flow to the high-pressure pump.

7. The fuel injection system according to claim 5, wherein the safety valve device (12) has a valve housing (13) in which a spring-preloaded control piston (14) is disposed for movement back and forth, and depending upon the fuel filter pressure difference, this control piston unblocks a shutoff bore (16) in the valve housing (13), through which the fuel flow delivered by the pre-feed pump (2) travels to the high-pressure pump, or unblocks a diversion bore (17) in the valve housing (13), through which the fuel flow delivered by the pre-feed pump (1) travels back into the fuel tank (1).

8. The fuel injection system according to claim 6, wherein the safety valve device (12) has a valve housing (13) in which a spring-preloaded control piston (14) is disposed for movement back and forth, and depending upon the fuel filter pressure difference, this control piston unblocks a shutoff bore (16) in the valve housing (13), through which the fuel flow delivered by the pre-feed pump (2) travels to the high-pressure pump, or unblocks a diversion bore (17) in the valve housing (13), through which the fuel flow delivered by the pre-feed pump (1) travels back into the fuel tank (1).

9. The fuel injection system according to claim 5, in which an expansion material element (28) is disposed in a bypass (10) that circumvents the safety valve device (12).

10. The fuel injection system according to claim 6, in which an expansion material element (28) is disposed in a bypass (10) that circumvents the safety valve device (12).

11. The fuel injection system according to claim 7, in which an expansion material element (28) is disposed in a bypass (10) that circumvents the safety valve device (12).

12. The fuel injection system according to claim 8, in which an expansion material element (28) is disposed in a bypass (10) that circumvents the safety valve device (12).

13. The fuel injection system according to claim 5, in which the safety valve device (12) and the expansion material element (28) are integrated into a cover of the fuel filter (8).

14. The fuel injection system according to claim 6, in which the safety valve device (12) and the expansion material element (28) are integrated into a cover of the fuel filter (8).

15. The fuel injection system according to claim 7, in which the safety valve device (12) and the expansion material element (28) are integrated into a cover of the fuel filter (8).

16. The fuel injection system according to claim 8, in which the safety valve device (12) and the expansion material element (28) are integrated into a cover of the fuel filter (8).

17. The fuel injection system according to claim 9, in which the safety valve device (12) and the expansion material element (28) are integrated into a cover of the fuel filter (8).

18. The fuel injection system according to claim 10, in which the safety valve device (12) and the expansion material element (28) are integrated into a cover of the fuel filter (8).

19. The fuel injection system according to claim 5, in which the safety valve device (12) or the expansion material element (28) are integrated into a cover of the fuel filter (8).

20. The fuel injection system according to claim 6, in which the safety valve device (12) or the expansion material element (28) are integrated into a cover of the fuel filter (8).

21. The fuel injection system according to claim 7, in which the safety valve device (12) of the expansion material element (28) are integrated into a cover of the fuel filter (8).

22. The fuel injection system according to claim 8, in which the safety valve device (12) or the expansion material element (28) are integrated into a cover of the fuel filter (8).

23. The fuel injection system according to claim 9, in which the safety valve device (12) or the expansion material element (28) are integrated into a cover of the fuel filter (8).

24. The fuel injection system according to claim 10, in which the safety valve device (12) or the expansion material element (28) are integrated into a cover of the fuel filter (8).

* * * * *

UNITED STATES PATENT AND TRADEMARK OFFICE

CERTIFICATE OF CORRECTION

PATENT NO. : 6,520,162 B1
DATED : February 18, 2003
INVENTOR(S) : Peter Schueler It is certified that error appears in the above-identified patent and that said Letters Patent is hereby corrected as shown below:

Title page,
Item [22], should read as follows:

-- [22] Filed: December 10, 1999 --

Signed and Sealed this

Seventeenth Day of June, 2003

JAMES E. ROGAN
*Director of the United States Patent and Trademark Office*